US011368770B2

(12) United States Patent
Huang et al.

(10) Patent No.: US 11,368,770 B2
(45) Date of Patent: Jun. 21, 2022

(54) SPEAKER BOX DEVICE AND MOBILE TERMINAL USING SAME

(71) Applicant: AAC Technologies Pte. Ltd., Singapore (SG)

(72) Inventors: Xingzhi Huang, Shenzhen (CN); Lin Liu, Shenzhen (CN); Dijiang Tong, Shenzhen (CN); Zhe Zhang, Shenzhen (CN); Jun Wu, Shenzhen (CN); Zhichen Chen, Shenzhen (CN); Zhaoyu Yin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/992,148

(22) Filed: Aug. 13, 2020

(65) Prior Publication Data

US 2021/0029427 A1 Jan. 28, 2021

Related U.S. Application Data

(63) Continuation of application No. PCT/CN2019/097577, filed on Jul. 24, 2019.

(30) Foreign Application Priority Data

Jul. 22, 2019 (CN) ..... 201921160321.2

(51) Int. Cl.
*H04R 1/02* (2006.01)

(52) U.S. Cl.
CPC ..... *H04R 1/02* (2013.01)

(58) Field of Classification Search
CPC ..... H04R 9/022; H04R 2499/11; H05K 7/20136; H05K 7/20145; H05K 7/20154; H05K 7/20445
See application file for complete search history.

(56) References Cited

U.S. PATENT DOCUMENTS

| | | | | |
|---|---|---|---|---|
| 3,778,551 | A * | 12/1973 | Grodinsky | H05K 7/209 381/335 |
| 6,327,144 | B1 * | 12/2001 | May | H01H 13/86 361/679.47 |
| 9,354,677 | B2 * | 5/2016 | Reilly | H05K 7/20136 |
| 9,552,026 | B2 * | 1/2017 | Chang | G06F 1/1656 |
| 10,045,461 | B1 * | 8/2018 | Boozer | H04R 1/00 |
| 10,306,356 | B2 * | 5/2019 | Katz | H04R 1/021 |
| 10,317,960 | B2 * | 6/2019 | Wong | G06F 1/203 |

(Continued)

FOREIGN PATENT DOCUMENTS

| | | | | |
|---|---|---|---|---|
| GB | 2322500 A | * | 8/1998 | H04B 1/3833 |
| JP | 03211796 A | * | 9/1991 | |

*Primary Examiner* — Ryan Robinson
(74) *Attorney, Agent, or Firm* — W&G Law Group

(57) ABSTRACT

The present application discloses a speaker device including a speaker box, a heating element and a heat conductor. The speaker box comprises a housing and a speaker unit provided with a diaphragm arranged in the housing. The housing comprises a plastic member provided with a through hole and a metal clamping plate. The housing further comprises a sound outlet channel jointly forming a front cavity with a front acoustic cavity. Heat transferred by the heat conductor is conducted to the front cavity, and heat dissipation of the heating element is achieved by means of an air cooling effect formed by air flow in the front cavity.

10 Claims, 4 Drawing Sheets

(56) References Cited

U.S. PATENT DOCUMENTS

| | | | | |
|---|---|---|---|---|
| 10,425,739 | B2 * | 9/2019 | Xu | H04R 1/345 |
| 10,827,273 | B2 * | 11/2020 | Nussbaum | H04R 9/022 |
| 10,841,706 | B2 * | 11/2020 | Davis | H04R 9/022 |
| 2011/0164383 | A1 * | 7/2011 | Kadijk | H05K 7/20972 361/690 |
| 2013/0312429 | A1 * | 11/2013 | Greuet | F25B 9/14 62/6 |
| 2018/0292871 | A1 * | 10/2018 | Weigand | G06F 1/203 |
| 2020/0404402 | A1 * | 12/2020 | Lin | H04R 1/02 |

* cited by examiner

SPEAKER BOX DEVICE AND MOBILE TERMINAL USING SAME

FIELD OF THE PRESENT DISCLOSURE

The present application relates to heat dissipation technology of a mobile terminal, in particular to a speaker box device with a heat dissipation function and a mobile terminal provided with the speaker box device.

DESCRIPTION OF RELATED ART

With development of the mobile terminal, the mobile terminal comprises more and more components, so that confront heat dissipation problems are severe increasingly.

In terms of heat dissipation of the mobile terminal in the related art, the input of a heat tube clings to the heating element and the condensing end is inlaid into an aluminum alloy middle frame of the mobile terminal. The hollow heat tube is internally filled with a liquid, heat enters from the input end, the liquid at the input end is heated to evaporate and penetrates the hollow heat tube to be cooled gradually at the condensing end lower in temperature, and vapor becomes the liquid again. The process is repeated continuously and heat generated by the heating element is transferred to a large area aluminum alloy middle frame heat dissipator quickly, so that quick and effective heat dissipation is performed. However, the structure dissipating heat in this way is complex and low in heat dissipating efficiency.

SUMMARY OF THE INVENTION

One of the main objects of the present invention is to provide a speaker device with improved heat dissipation efficiency.

Accordingly, the present invention provides a speaker box device, comprising: a speaker box; and a heating element spaced from the speaker box. The speaker box comprises a housing and a speaker unit in the housing, the speaker unit comprises a diaphragm. The housing comprises a plastic member with a through hole, and a metal clamping sheet having a main body part covering the through hole, a fixation part extending from the main body part and an extension part extending from the fixation part. The diaphragm is spaced from the main body part for forming a front acoustic cavity, the fixation part is embedded in the plastic member. The extension part extends out of the housing. The housing further comprises a sound outlet channel communicating with the front acoustic cavity for jointly forming a front cavity, and the main body part is exposed in the front cavity. The speaker device further comprises a heat conductor, and the heat conductor comprises a first end connected to the heating element, a second end connected to the extension part and a connection part connecting the first end to the second end.

In addition, the plastic member and the metal clamping sheet are integrally formed.

In addition, the fixation part, the main body part and the extension part are integrally formed, and the fixation part is formed by being bended and extending from one side of the main body part.

In addition, the extension part is formed by extending horizontally from one side of the fixation part.

In addition, the housing comprises an upper cover and a lower cover matched with the upper cover; the upper cover comprises the plastic member and the metal clamping sheet; the plastic member comprises a top wall and a side wall bended and extending along the top wall, the top wall is provided with a through hole, and the main body part covers the through hole and is arranged directly opposite to the diaphragm.

In addition, the side wall comprises a first surrounding wall and a second surrounding wall opposite to the first supporting wall; the sound outlet channel is arranged on the first surrounding wall, the fixation part is embedded into the second surrounding wall, and the extension part extends from the second surrounding wall.

In addition, the second end is connected to the extension part in a heat conducting manner.

In addition, the plastic member further comprises a circular stair part extending toward the lower cover from the top wall, and the circular stair part is arranged surrounding the through hole for supporting the speaker unit.

The present invention further provides a mobile terminal, comprising a housing provided with a sound outlet communicating to outside, a speaker device as described above, wherein the speaker box and the heating element are mounted with the housing in a spaced manner, and the sound outlet channel communicates with the sound outlet.

In addition, the heating element is one or two of a processor and a battery.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
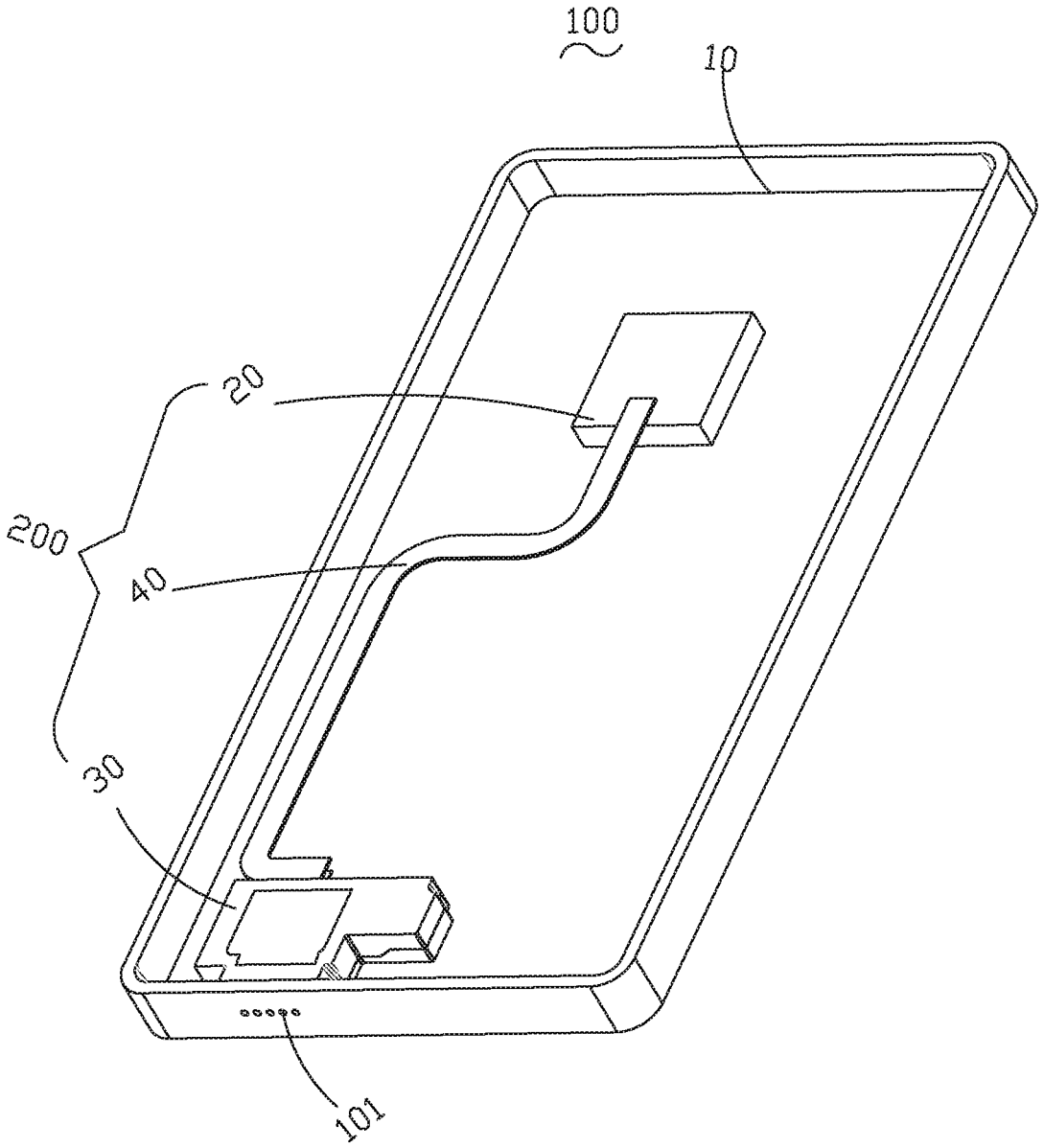
FIG. 1 is an isometric view of a mobile terminal provided by an embodiment of the present application.
Figure 2:
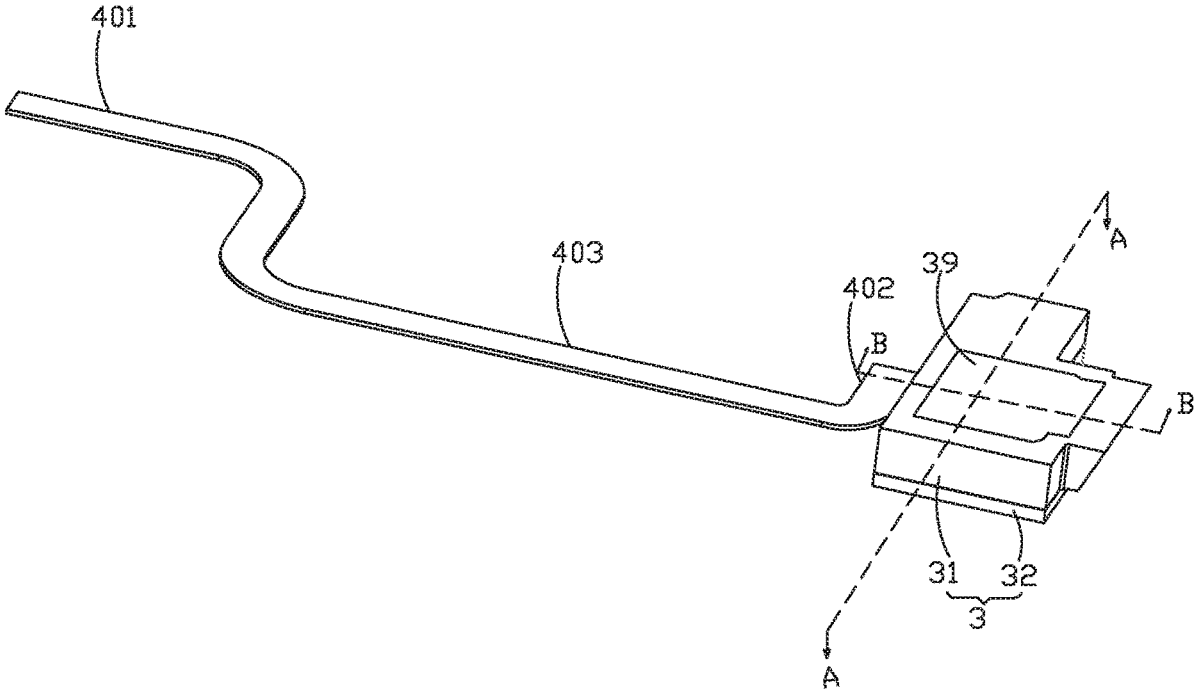
FIG. 2 is a isometric view of a speaker box device (the heating element is not included) shown in FIG. 1.
Figure 3:
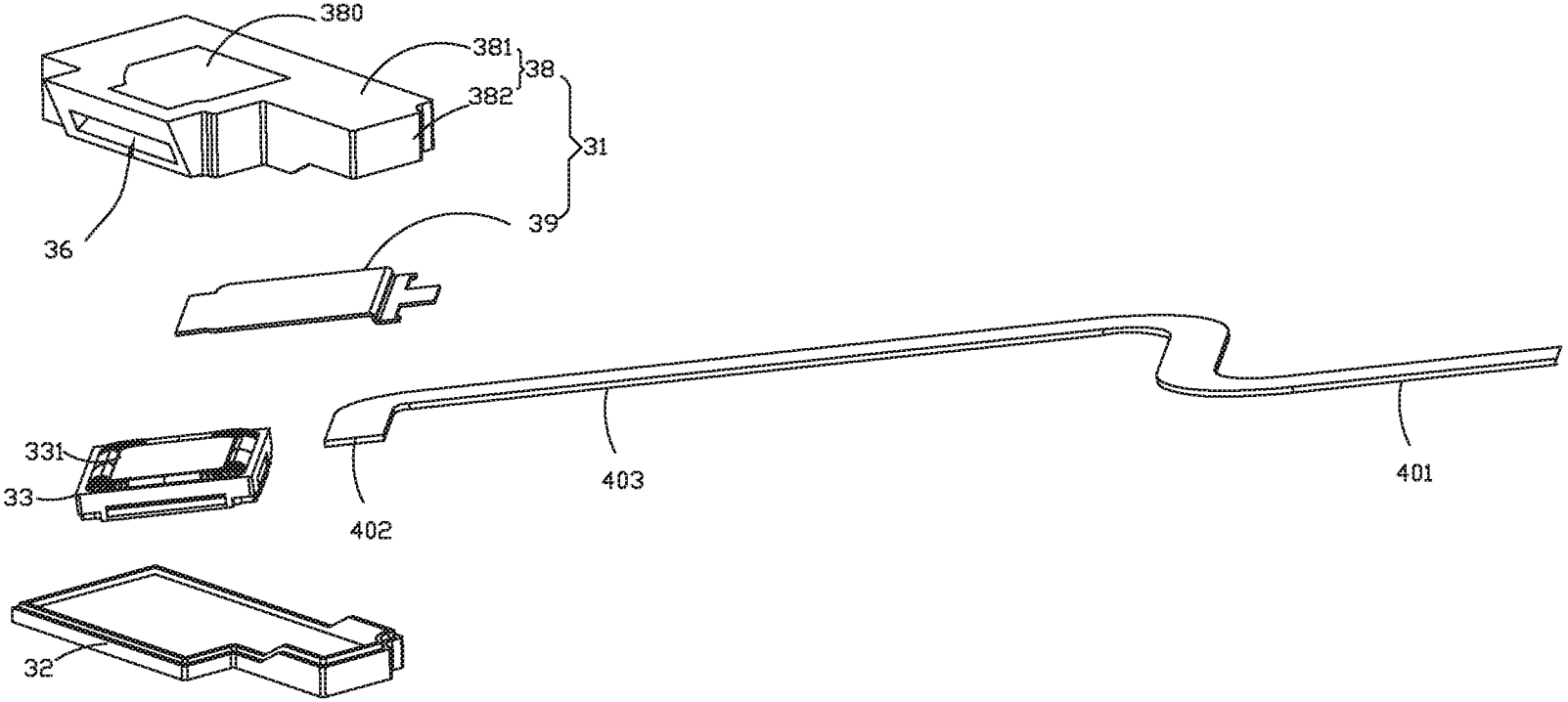
FIG. 3 is an exploded view of the speaker box device shown in FIG. 2.
Figure 4:
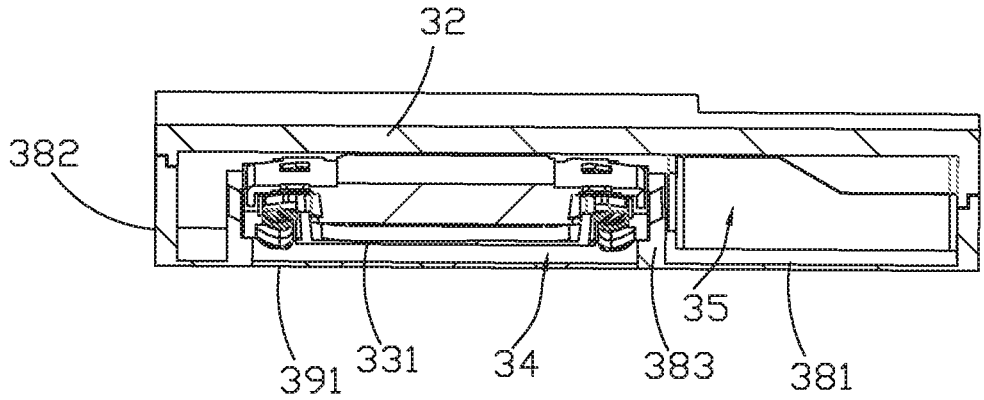
FIG. 4 is a cross-sectional view taken along line A-A in FIG. 2.
Figure 5:
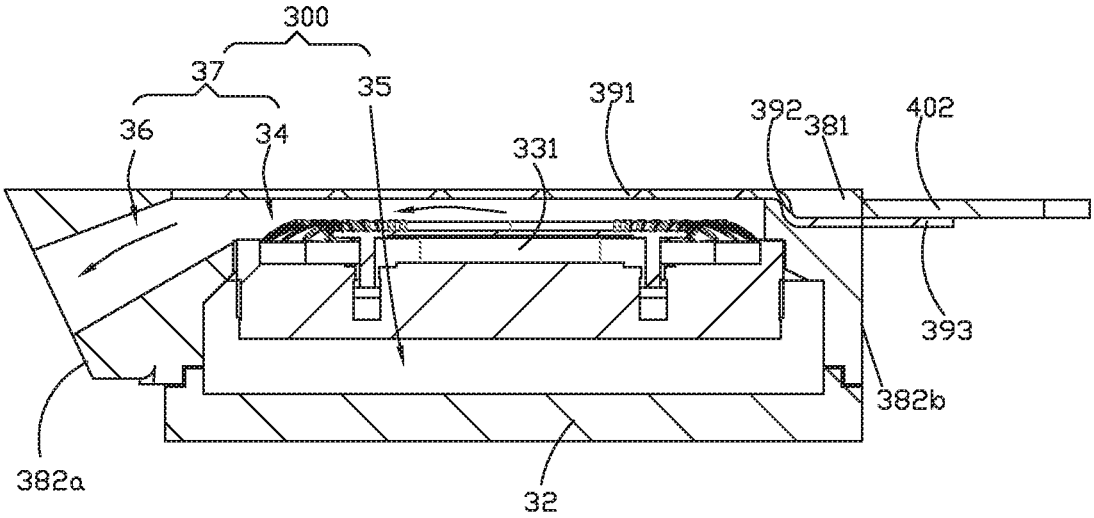
FIG. 5 is a cross-sectional view taken along line B-B in FIG. 2.
Figure 6:
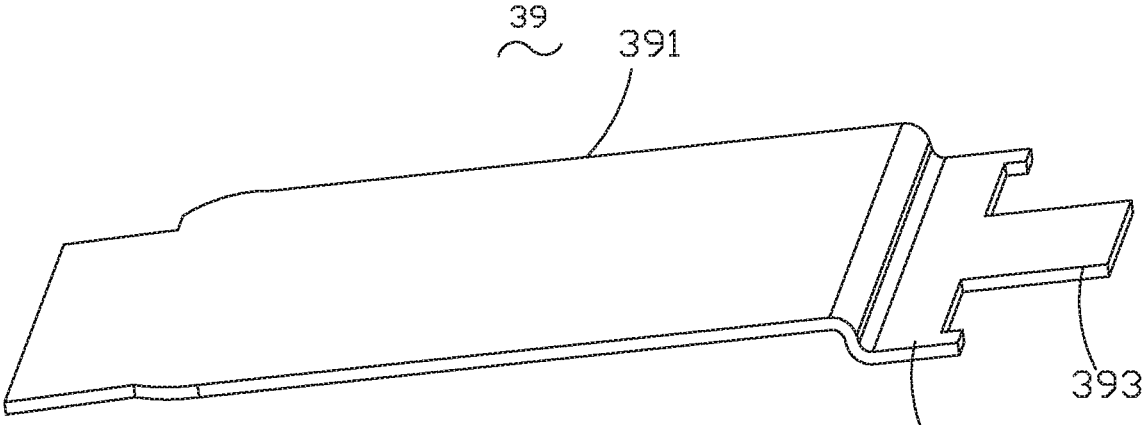
FIG. 6 is an isometric view of a metal clamping plate in FIG. 3.

With reference to FIGS. 1-6 simultaneously, a mobile terminal 100 provided by the present application comprises a housing body 10, a heating element 20 and a speaker box 30 mounted on the housing body 10 and a heat conductor 40 connecting the speaker box 30 to the heating element 20. The heat conductor 40 is used for conducting heat generated by the heating element 20 out to the speaker box 30 and conducting the heat out to external air through the speaker box 30. The housing body 10 can be a component such as a back cover of the mobile terminal 100, and the housing body 10 is provided with a sound outlet 101 for outputting a sound generated by the speaker box 30 to outside. The heating element 20 can be a component capable of generating heat, such as a processor and a battery, of the mobile terminal 100. In the embodiment, the heating element 20, the speaker box 30 and the heat conductor 40 jointly form a speaker box device 200.

The speaker box 30 comprises a housing 3 and a speaker unit 33 accommodated in the housing 3. The housing 3 comprises an upper cover 31 and a lower cover 32 matched with the upper cover 31 to form an accommodation space 300. The speaker unit 33 is accommodated in the accommodation space 300. The upper cover 31 and the lower cover 32 can be either of an integrated structure or a split structure.

The speaker unit 33 and the upper cover 31 are arranged in a spaced manner and jointly encircle a front acoustic cavity 34; the speaker unit 33, the upper cover 31 and the lower cover 32 jointly encircle a back cavity 35.

The speaker box 30 further comprises a sound outlet channel 36 communicating to outside. The sound outlet channel 36 communicates to the front acoustic cavity 34 to form a front cavity 37. In the embodiment, the sound outlet channel 36 is formed in the upper cover 31. The sound outlet channel 36 communicates to the outside through the sound outlet 101.

In the embodiment, the speaker unit 33 separates the accommodation space 300 into the front cavity 37 and the back cavity 35. The front cavity 37 comprises the front acoustic cavity 34 and the sound outlet channel 36 for generating a sound; the back cavity 35 is used for improving the low frequency acoustic performance of the speaker box 30.

Particularly, the speaker unit 33 further comprises a diaphragm 331. The diaphragm 331 inputs a pulse signal of lower frequency (lower than 1000 Hz) to drive the diaphragm of a speaker to vibrate to push air in the front cavity to flow to form an air cooling effect. When the speaker does not execute a music play task, the speaker can play the pulse signal independently. When the speaker executes the music play task, the speaker can superpose the pulse signal into a music signal. Since the signal is a pulse signal of an ultralow frequency, the signal is not heard by ears, and a normal hearing effect is not affected.

The upper cover 31 comprises a plastic member 38 provided with a through hole 380 and a metal clamping plate 39 arranged on the through hole 380 and connected to the heat conductor 40. The metal clamping plate 39 comprises a main body part 391, a fixation part 392 extending from the main body part 391 and an extension part 393 extending from the fixation part 392, the main body part 391 covers the through hole 380, the fixation part 392 is buried in the plastic member, and the extension part 393 extend out of the upper cover 31 of the housing 3.

Preferably, the main body part 391, the fixation part 392 and the extension part 393 are integrally formed. The diaphragm 331 and the main body part 391 are arranged in a spaced manner to form the front acoustic cavity 34. The sound outlet channel 36 communicates to the front acoustic cavity 34 to jointly form the front cavity 37, that is, the main body part 391 is exposed in the front cavity 37. The metal clamping plate 39 can be made from a heat conducting metal, for example, steel or copper and the like. Preferably, the fixation part 392 is formed by bending and extending along one side of the main body part 391, and the extension part 393 is formed by extending horizontally along one side of the fixation part 392. Preferably, the metal clamping plate 39 and the plastic member 38 are integrally formed by injection molding. It can be understood that the lower cover 32 can be made from a plastic material.

The plastic member 38 comprises a top wall 381 and a side wall 382 bending and extending along the top wall 381. The side wall 382 is arranged around the top wall 381. In the embodiment, the sound outlet channel 36 is formed on the side wall 382. The top wall 381 is provided with the through hole 380, and the main body part 391 covers the through hole 380 and is arranged directly opposite to the diaphragm 331. The side wall 382 comprises a first surrounding wall 382*a* and a second surrounding wall 382*b* arranged oppositely, the sound outlet channel 36 is arranged on the first surrounding wall 382*a*, the fixation part 392 is buried into the second surrounding wall 382*b*, and the extension part 393 extends out from the second surrounding wall 382*b*.

The plastic member 38 further comprises a circular stair part 383 formed by extending toward the lower cover 32 from the top wall 381. The circular stair part 383 is arranged around the through hole 380. The speaker unit 33 is fixed to the circular sitar part 383, and in particular, the speaker unit 33, the circular stair part 383 and the main body part 391 jointly encircle the front acoustic cavity 34. The circular stair part 383, the speaker unit 33, the top wall 381, the side wall 382 and the lower cover 32 jointly encircle the back cavity 35.

The heat conductor 40 is substantially hollow tubular and is a hollow tube made from a heat conducting material such as copper. Alternatively, the heat conductor can be a solid part. The heat conductor 40 comprises a first end 401 connected to the heating element 20, a second end 402 for connecting heat generated by the heating element 20 and being connected to the extension part 393 of the metal clamping plate 39 in the housing of the speaker box 30 and a connection part 403 connecting the first end 401 to the second end 402.

The connection part 403 is used for transferring heat collected by the first end 401 to the second end 402, the second end 402 is used for transferring the heat to the extension part 393, so that the heat is conducted to the main body part 391 through the fixation part 392 to push air in the front cavity to flow to form the air cooling effect as the diaphragm vibrates so as to dissipate heat transferred by the second end 402 through the sound outlet 101. Particularly, the second end 402 is connected to the extension part 393 in a heat conducting manner. The second end 402 and the extension part 393 either can be in contact or can be welded.

Compared with the related art, by arranging the heat conductor, connecting one end of the heat conductor to the heating element of the mobile terminal and connecting the other end of the heat conductor to the metal clamping plate in the speaker box, heat of the heating element is transferred to the front cavity. The diaphragm in the front cavity vibrates, particularly, vibrates at low frequency to push the air in the front cavity to flow to form the air cooling effect so as to discharge heat conducted in the heat conductor through the sound outlet. In this way, a simple structure can be adopted to achieve heat dissipation of the mobile terminal, and the heat dissipation efficiency is high.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box device, comprising:

a speaker box;

a heating element spaced from the speaker box;

the speaker box comprising a housing and a speaker unit in the housing, the speaker unit comprising a diaphragm; the housing comprises a plastic member with a through hole, and a metal clamping sheet having a main body part covering the through hole, a fixation part extending from the main body part and an extension part extending from the fixation part;

wherein the diaphragm is spaced from the main body part for forming a front acoustic cavity, the fixation part is embedded in the plastic member;

the extension part extends out of the housing;

the housing further comprises a sound outlet channel communicating with the front acoustic cavity for jointly forming a front cavity, and the main body part is exposed in the front cavity;

the speaker device further comprises a heat conductor, and the heat conductor comprises a first end connected to the heating element, a second end connected to the extension part and a connection part connecting the first end to the second end.

2. The speaker device as described in claim 1, wherein the plastic member and the metal clamping sheet are integrally formed.

3. The speaker device as described in claim 2, wherein the fixation part, the main body part and the extension part are integrally formed, and the fixation part is formed by being bended and extending from one side of the main body part.

4. The speaker device as described in claim 3, wherein the extension part is formed by extending horizontally from one side of the fixation part.

5. The speaker device as described in claim 4, wherein the housing comprises an upper cover and a lower cover matched with the upper cover; the upper cover comprises the plastic member and the metal clamping sheet; the plastic member comprises a top wall and a side wall bended and extending along the top wall, the top wall is provided with a through hole, and the main body part covers the through hole and is arranged directly opposite to the diaphragm.

6. The speaker device as described in claim 5, wherein the side wall comprises a first surrounding wall and a second surrounding wall opposite to the first surrounding wall; the sound outlet channel is arranged on the first surrounding wall, the fixation part is embedded into the second surrounding wall, and the extension part extends from the second surrounding wall.

7. The speaker device as described in claim 6, wherein the second end is connected to the extension part in a heat conducting manner.

8. The speaker device as described in claim 5, wherein the plastic member further comprises a circular stair part extending toward the lower cover from the top wall, and the circular stair part is arranged surrounding the through hole for supporting the speaker unit.

9. A mobile terminal, comprising a housing provided with a sound outlet communicating to outside, a speaker device as described in claim 1, wherein the speaker box and the heating element are mounted with the housing in a spaced manner, and the sound outlet channel communicates with the sound outlet.

10. The mobile terminal as described in claim 9, wherein the heating element is one or two of a processor and a battery.

* * * * *